US006126263A

United States Patent [19]

Hotomi et al.

[11] Patent Number: 6,126,263

[45] Date of Patent: Oct. 3, 2000

[54] INKJET PRINTER FOR PRINTING DOTS OF VARIOUS SIZES

[75] Inventors: Hideo Hotomi, Nishinomiya; Shoichi Minato, Sakai, both of Japan

[73] Assignee: Minolta Co., Ltd., Osaka, Japan

[21] Appl. No.: 08/974,611

[22] Filed: Nov. 19, 1997

[30] Foreign Application Priority Data

Nov. 25, 1996 [JP] Japan ..... 8-313808

[51] Int. Cl.[7] ..... B41J 2/205

[52] U.S. Cl. ..... 347/15

[58] Field of Search ..... 347/10, 11, 15

[56] References Cited

U.S. PATENT DOCUMENTS

| | | | |
|---|---|---|---|
| 4,499,479 | 2/1985 | Chee-Shuen Lee et al. | 347/15 |
| 5,146,236 | 9/1992 | Hirata et al. | 347/15 X |
| 5,208,605 | 5/1993 | Drake | 347/15 |
| 5,412,410 | 5/1995 | Rezenka | 347/15 |
| 5,461,403 | 10/1995 | Wallace et al. | 347/10 |
| 5,642,142 | 6/1997 | Bohorquez | 347/15 |
| 5,745,131 | 4/1998 | Kneezel et al. | 347/15 |
| 5,790,139 | 8/1998 | Umeno et al. | 347/10 |
| 5,877,786 | 3/1999 | Sekiya et al. | 347/15 |
| 5,880,750 | 3/1999 | Takahashi | 347/10 |

FOREIGN PATENT DOCUMENTS 0437062 7/1991 European Pat. Off. .

*Primary Examiner*—William J. Royer
*Attorney, Agent, or Firm*—Sidley & Austin

[57] ABSTRACT

An inkjet printer emits ink drops of controlled size in response to a voltage signal applied to a piezoelectric element in the inkjet head. Drop size control over a range of selectable drop sizes as well as drop size uniformity are regulated by controlling the voltage pulse shape applied to the piezoelectric element. To provide for drop size control over a wide range of drop sizes, a plurality of voltage drive methods are provided which are interchanged based on the selected drop size desired.

19 Claims, 14 Drawing Sheets

FIG. 3
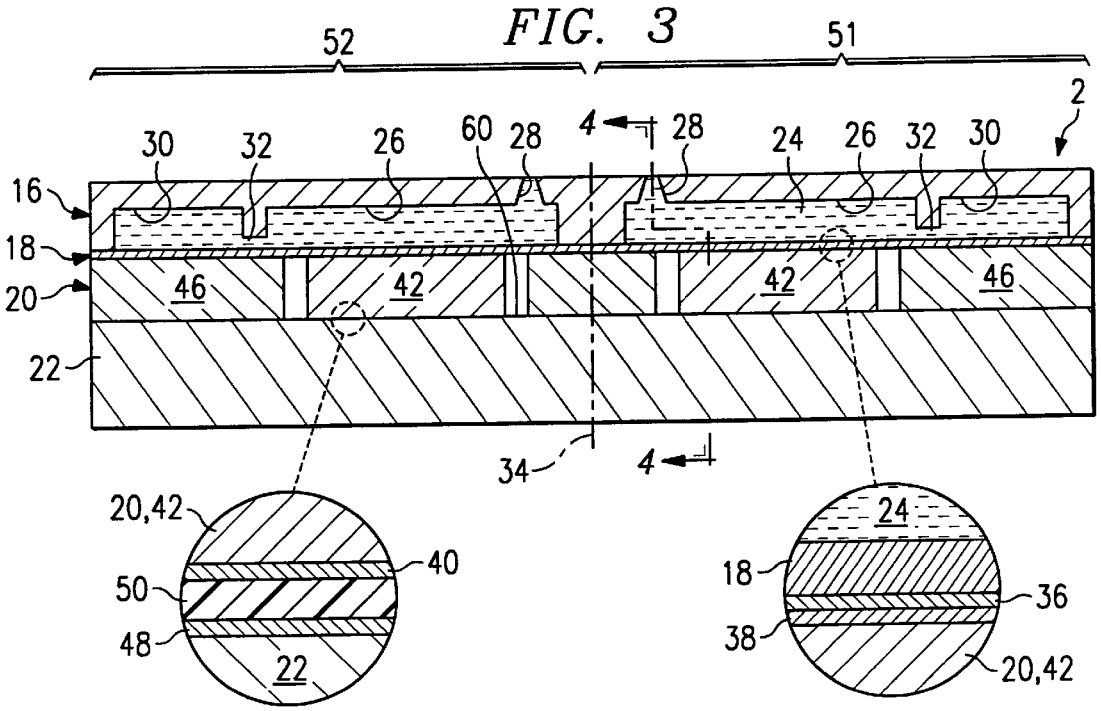
FIG. 3a
FIG. 3b
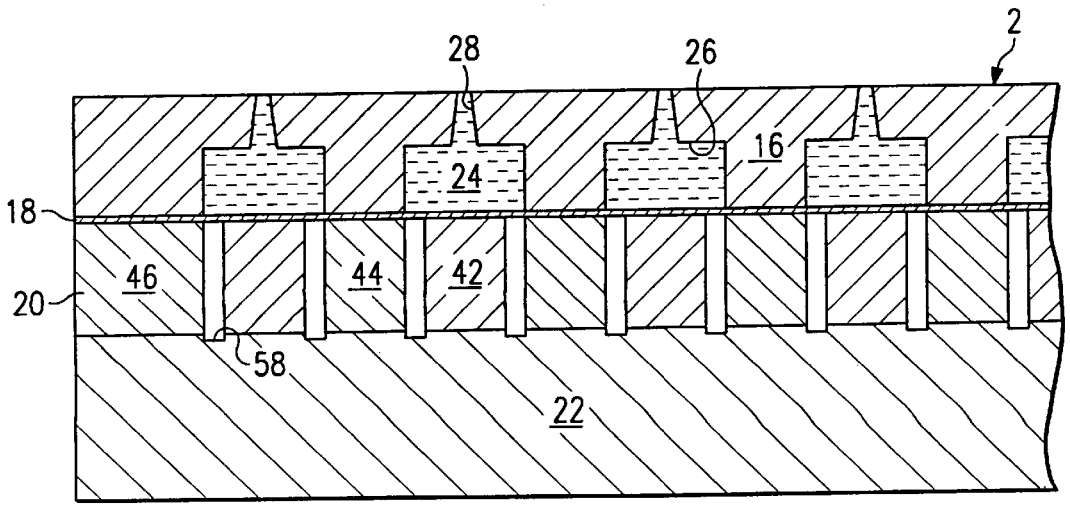
FIG. 4

SMALL DIAMETER RANGE

LARGE DIAMETER RANGE

INKJET PRINTER FOR PRINTING DOTS OF VARIOUS SIZES

FIELD OF THE INVENTION

The present invention relates to a drive device and method for an inkjet head of an inkjet printer, and specifically relates to a drive device for an inkjet head that can print dots of a plurality of diameters by applying a voltage to a piezoelectric element of the inkjet head.

BACKGROUND OF THE INVENTION

Inkjet printers are known that use printheads having a piezoelectric element. With these printers, it is known to print dots of different diameters by applying voltages of different levels to the piezoelectric element. FIG. 35 is a graph showing an example of the relationship between dot diameter and the applied voltage for a conventional approach. For this example, printing was performed for nine levels of dot diameters from small to large. At all levels, a voltage was applied to the piezoelectric element for an interval of 40 $\mu$sec. The voltage was increased in conjunction with the increase in gradation level. Accordingly, dots of different diameters can be printed by a single printhead.

To further explain the example shown in FIG. 35, a voltage of 5V was applied at level 1, a voltage of 10 V was applied at level 2, a voltage of 15V was applied at level 3, a voltage of 20V was applied at level 4, a voltage of 25V was applied at level 5, a voltage of 30V was applied at level 6, a voltage of 40V was applied at level 7, a voltage of 50V was applied at level 8, and a voltage of 60V was applied at level 9. At each of the 9 levels the above described voltage was applied for a 40 $\mu$sec interval. As can be seen from the graph, the size of the printed dots sequentially increases from level 1 to level 9.

There are three disadvantages described below which are associated with the conventional art.

First, as illustrated by the data in FIG. 35, it is necessary to apply a high voltage to the piezoelectric element to print large diameter dots. It is generally difficult, however, to control the voltage value in the high voltage range. There is concern, therefore, that the waveform will become blunted and result in unstable printing. Furthermore, high-voltage electric circuits and voltage boosters are expensive and increase the cost of the inkjet printhead device.

Second, when printing small diameter dots, a variation may occur in the applied voltage. The diameter of the airborne ink drop is sensitive to and is changed by this voltage variation. Additionally, the variation in ink drop diameter is made more apparent by the spreading of the ink drop after it adheres to the sheet being printed. Accordingly, dot diameter dispersion is a severe disadvantage when printing dots of identical diameter.

Third, in the conventional art, various dot irregularities occur in printing including satellite dots, curves, dot division and the like, due to the difficulty of achieving proper airborne delivery of the ink.

SUMMARY OF THE INVENTION

It is an object of the present invention to provide an inkjet printhead device and inkjet drive method that can print dots of varying sizes, but that reduces or eliminates the above-described disadvantages.

In one aspect of the present invention, different piezoelectric drive methods are used to control different ranges of possible dot sizes to be printed. A first drive method is used to print dots for a first range of possible dot sizes, and a second drive method is used to print dots for another range of dot sizes. By using more than one drive method, each range of dot sizes is produced with a drive method optimized for that dot range.

In a second aspect of the present invention, multiple voltage pulses are applied to the piezoelectric element in order to print a single large diameter dot.

In another aspect of the present invention, various voltage pulse waveforms are applied to the piezoelectric element to print a graduated series of dot sizes where repeated dots within a graduation level have a high degree of uniformity of size.

It is an additional object of the present invention to provide an inkjet printhead device and inkjet drive method which can print dots of varying sizes and which can be inexpensively produced and applied.

BRIEF DESCRIPTION OF THE DRAWINGS

FIG. 3 is a sectional view of the item from FIG. 2 through section 3—3.

FIG. 4 is a sectional view of the item from FIG. 3 through section 4—4.

DETAILED DESCRIPTION OF THE PREFERRED EMBODIMENTS

Figure 1:
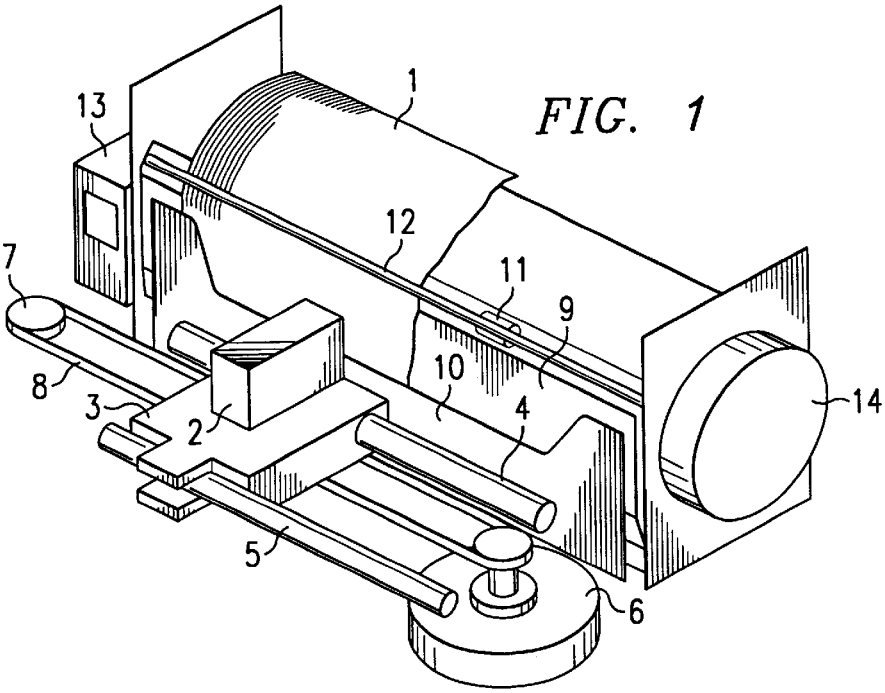
FIG. 1 is a perspective view showing the construction of the inkjet printer of a first embodiment of the present invention.

FIG. 1 is a perspective view of an inkjet printer of a first embodiment of the present invention.

Referring to the drawing, a thin print sheet 1 formed of paper, plastic or the like is fed manually, or via a sheet feeding device such as a cut-sheet feeder or the like, and is delivered to the printing position opposite printhead 2 by controlling the amount of rotation of a feed roller (not illustrated). The printhead 2 is mounted on a carriage 3 which is movable in a direction perpendicular to the direction of transport of the print sheet.

A piezoelectric element which will be described later is used in the printhead 2 to accomplish printing. Printhead 2 prints when the piezoelectric element deforms in response to the application of a voltage. The piezoelectric element is arranged next to an ink-filled channel so that the ink is discharged from a nozzle provided in a channel when the channel volume changes based on movement of the piezoelectric element.

Printhead 2 has a plurality of discharge ports arrayed vertically on the printhead surface which confronts print sheet 1. The printhead 2 is carried on carriage 3, which is in turn supported on oscillating shafts 4 and 5 so as to be capable of reciprocating movement. Carriage 3 is moved forward and back via a drive motor 6 by means of a timing belt 8 which is wrapped around drive motor 6 and an idle pulley 7. Carriage 3 is moved in the width direction of print sheet 1 (i.e., a direction transverse to print sheet 1) to print an image on a predetermined line, whereupon the print sheet 1 is fed vertically one line width so as to print the image of a next line.

A platen 9 is provided at a position opposite the printhead 2 and functions as a guide panel to guide the print sheet 1 across the transport path. The print sheet 1 is pressed against the platen 9 by a press plate 10 on the upstream side of the print range that is the range of movement of printhead 2, i.e., at an area as near as possible to the print range. Thus, the print sheet 1 is prevented from floating by this arrangement. A print sheet which has passed the printing area is ejected by a discharge roller 11 disposed on the downstream side therefrom in the direction of sheet transport, and a roller 12 that presses against discharge roller 11.

A recovery unit 13 is provided at a position opposite printhead 2 at a position separated from platen 9 to suitably recover mis-discharged ink from printhead 2. A transport knob 14 is provided on a sheet transport roller to allow manual transport of a print sheet 1.

Figure 2:
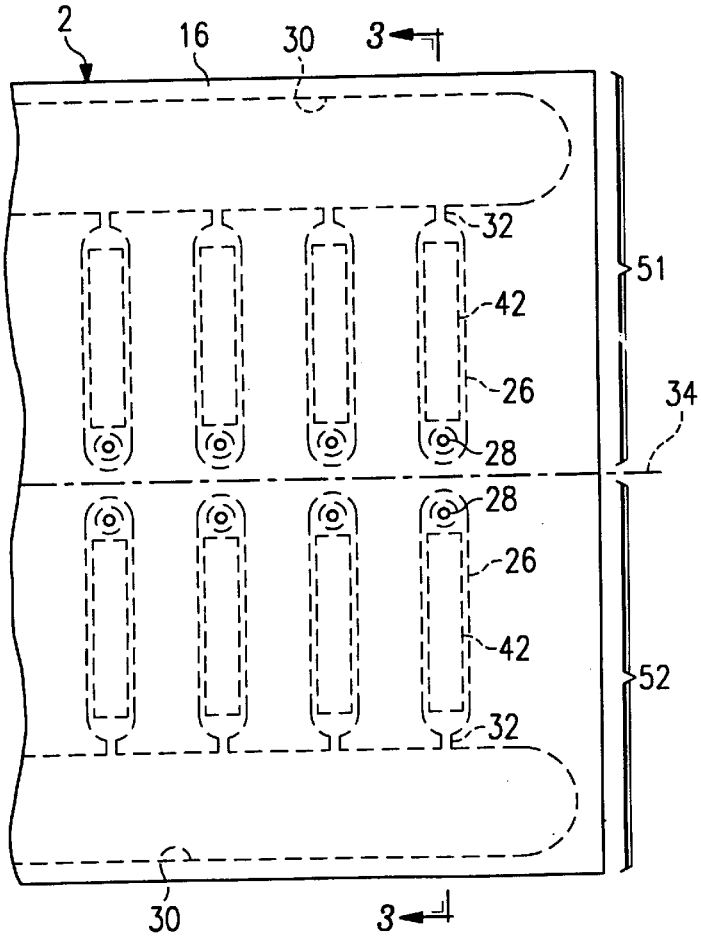
FIG. 2 is a plan view of part of head 2 of FIG. 1.

FIG. 2 is a plan view of part of printhead 2 of FIG. 1 as viewed from the surface confronting the print sheet. FIG. 3 is a sectional view of the 3—3 cross section of FIG. 2, and FIG. 4 is a sectional view of the 4—4 cross section view of FIG. 3.

Printhead 2 includes a yellow head, magenta head, cyan head, and black head, and discharges the colored ink from the respective heads onto a print sheet 1. FIG. 2 is a plan view of part of the yellow head which discharges yellow ink. Printhead 2 is constructed so as to be capable of discharging inks of four colors by providing the four color sections in a vertical direction in FIG. 2.

Referring to FIG. 2, printhead 2 comprises a head section 52 to discharge large diameter ink drops (hereinafter referred to as "first head section 52"), and a head section 51 to discharge small diameter ink drops (hereinafter referred to as "second head section 51"). The diameter of the nozzle 28 of first head section 52 (hereinafter referred to as "large diameter nozzle") is larger than the diameter of the nozzle 28 of the second head section 51 (hereinafter referred to as "small diameter nozzle"). In one embodiment, for example, the nozzle 28 of the first head section 52 is 34 $\mu$m, and the nozzle diameter of the second head section 51 is 24 $\mu$m.

As shown in FIG. 3., the first head section 52 and second head section 51 are integrally constructed from a sandwich consisting of overlay channel plate 16, partition 18, oscillating plate 20, and baseplate 22. Channel plate 16 is formed of metal or synthetic resin. Channel plate 16 is treated by fine processing of electroplating, photolithography, or the like, on the surface opposite partition 18. The first head section 52 and the second head section 51 each respectively have a plurality of ink cavities 26 which accommodate ink 24, a nozzle 28 to discharge ink 24 from each of the ink cavities 26, an ink supply chamber 30 to accommodate replenishment ink 24, and an ink inlet 32 connecting each ink cavity 26 to the ink supply chamber 30.

As shown in FIG. 2, a plurality of ink cavities 26 are provided in first head section 52 and second head section 51 and form long parallel channels extending outwardly from center line 34. An ink supply chamber 30 for each of the first and second head sections is formed adjoining the ink cavities 26 and is arranged on the side of the ink cavities 26 opposite of center line 34. The ink supply chambers 30 are connected to an ink tank that is not shown in the drawings.

Nozzles 28, ink cavities 26, and piezoelectric elements 42 are capable of printing the images of a plurality of lines in only one movement of the printhead 2 because a plurality of said components are provided along the center line 34.

Partition 18 is a thin film formed of electrically conductive material, and is fixed between channel 16 and oscillating plate 20. Partition 18 is desirably attached in a state of predetermined tension.

Oscillating plate 20 comprises a well-known piezoelectric material (e.g., lead zirconate titanate (PZT)), the top surface and bottom surface of which are respectively provided with a common electrode 38 and an electrically conductive metal layer used as individual electrodes 40. In forming the structure of printhead 2, oscillating plate 20 is fixedly attached between partition 18 and baseplate 22. After oscillating plate 20 is fixedly attached to baseplate 22 via an electrically conductive adhesive 50 (refer to enlarged cross section (a) of FIG. 3), vertical channels 58 and horizontal channels 60 are formed thereon via a dicing process to divide the oscillating plate 20.

In the dicing process, oscillating plate 20 is separated into a plurality of piezoelectric elements 42, one element corresponding to each ink cavity 26. The parts of the oscillating plate 20 after dicing which do not form piezoelectric elements 42, form vertical and horizontal walls 44 and 46, respectively, which surround the piezoelectric elements 42. (Refer to FIG. 3 and FIG. 4 for illustrations of horizontal wall 46 and vertical wall 44, respectively.) Horizontal wall 46 is spaced apart from piezoelectric element 42 by a horizontal channel 60, and vertical wall 44 is spaced apart from piezoelectric element 42 by a vertical channel 58. The electrically conductive metal layer provided on the top and bottom of piezoelectric element 42 via the aforesaid dicing process is also divided by vertical channel 58 and horizontal channel 60. Referring to enlarged section views 3(*a*) and 3(*b*) of FIG. 3, the metal layer confronting partition 18 is a common electrode 38, and is adhered to partition 18 using an electrically conductive adhesive 36. The metal layer confronting baseplate 22 is the individual electrode 40.

Baseplate 22 is formed of a ceramic, metal, or synthetic resin. The surface of baseplate 22 confronting oscillating plate 20 is provided with a conductive lead 48 (refer to section view (a) of FIG. 3) corresponding to each piezoelectric element 42. The conductive lead 48 can be formed by a well-known sputtering or vacuum deposition method.

The aforesaid individual electrode 40 is electrically connected to a corresponding series of conductive leads 48 via a conductive adhesive 50. The conductive leads 48 together with the common electrode 38 form an address matrix whereby any individual piezoelectric element 42 can be electrically biased.

In printhead 2 of the aforesaid construction, ink 24 is supplied from ink tanks (not illustrated) to ink supply chambers 30. The ink 24 accommodated in ink supply chamber 30 is distributed to the various ink cavities 26 via ink inlets 32. Piezoelectric element 42 deforms when a predetermined voltage (print signal) is supplied from the drive circuit of the inkjet head and applied between the individual electrode 40 and the common electrode 38.

Printing is accomplished with the above described structure by the following process. Piezoelectric element 42 deforms when a print signal is supplied from the drive circuit, the deformation is transmitted to partition 18 which applies a pressure on the ink 24 accommodated within an ink cavity and the pressure on the ink causes a discharge of an ink drop for printing through ink nozzle 28.

The diameter of nozzle 28 of first head section 52 is larger than the diameter of the nozzle 28 of the second head section 51. Therefore, large diameter ink drops are discharged from the first head section 52, and small diameter ink drops are discharged from the second head section 51.

The piezoelectric member may be either a single layer type, or a multilayer type. A multilayer type piezoelectric member alternately interposes common electrodes and individual electrodes between a plurality of piezoelectric elements. For example, a multilayer piezoelectric member may comprise 20 layers of piezoelectric elements each layer of which is 35 $\mu$m in thickness.

Although common electrode 38 and individual electrode 40 are respectively provided on the top and bottom of piezoelectric element 42, the electrode forming method and electrical connection method are not limited to those described in the present embodiment, and may be variously modified. For example, a conductive partition 18 may also be used as a combined common electrode. Furthermore, the conductive adhesive 50 may also be used as a combined individual electrode. These approaches provide advantages in the fabrication of the electrodes thereby facilitating the manufacture of oscillating plate 20.

A filler material may be used to fill the channels 58 and 60 circumscribing each piezoelectric element 42 insofar as said filler is of a flexibility sufficient not to impair the deformation of piezoelectric element 42.

Although piezoelectric element 42 does not come into contact with the ink 24, the present invention may be adapted to an inkjet printhead constructed so as to allow contact between the piezoelectric element and the ink. In this instance, it is desirable that the ink-contact surface of the piezoelectric element be provided with a protective layer to prevent ink penetration.

The length of the ink cavity 26 and piezoelectric element 42 may be different in the first head section 52 and second head section 51. This difference in length will produce a larger difference in the size of the ink drops discharged from the respective first head and second head. Accordingly, the dynamic range of the gradient width can be broadened by controlling dot size.

Figure 5:
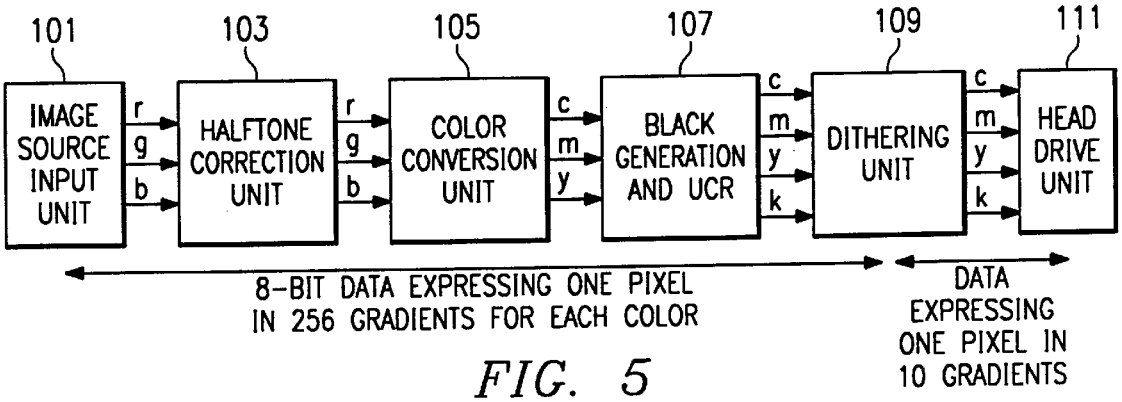
FIG. 5 is a block diagram of the image data processing circuit of the inkjet printer of FIG. 1.

FIG. 5 is a block diagram of the image data processing circuit of the aforesaid inkjet printer. Referring to the drawing, the image data processing circuit comprises an image source input unit 101 which receives the digital output from a microcomputer, digital camera, video and the like; halftone correction unit 103 to accomplish gradient correction of signals output from the image source input unit 101; color conversion unit 105 to accomplish color conversion of gradient-corrected signals; black generation+UCR (undercolor removal) unit 107 to subject color-converted signals to undercolor removal and output black data; and, dithering unit 109 to subject undercolor-removed signals to a dithering process. Dithering unit 109 is connected to the head drive unit 111, and the head drive unit 111 drives the large diameter nozzles and small diameter nozzles of printhead 2 for each color based on the dither-processed signals.

Image data are processed as red (R), green (G), and blue (B) from the image source input unit 101 to color conversion unit 105. Image data are processed as cyan (c), magenta (m), and yellow (y) between color conversion unit 105 and black generation+UCR unit 107. Image data are processed as cyan, (c), magenta (m), yellow (y), and black (k) from black generation+UCR unit 107 to head drive unit 111.

Image data are processed as 8-bit data representing one pixel in 256 gradients for each color from the image source input unit 101 to the dithering unit 109. Image data are processed as data representing one pixel in 10 gradients for each color between dithering unit 109 and head drive unit 111.

Figure 6:
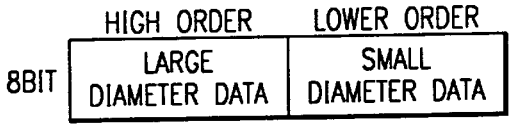
FIG. 6 shows the structure of the data output from dithering unit 109 of FIG. 5.

FIG. 6 shows the structure of the 10-gradient data output from dithering unit 109. Referring to the drawing, the data illustrates one pixel in 8-bits. The high order bits are used for large diameter dot data, the lower order bits are used for small diameter dot data. This corresponds to image data of gradient levels 0–4 which are printed by the small diameter nozzle, and image data of gradient levels 5–9 which are printed by the large diameter nozzle.

The data format shown in FIG. 6 corresponds to one color and one dot. This type of data is output for each dot of each color (i.e., cyan, magenta, yellow, black). Although data of 10 gradient levels are output as 8-bit data, the data are not limited to 10 gradient levels, nor is data output limited to 8-bit data.

Figure 7:
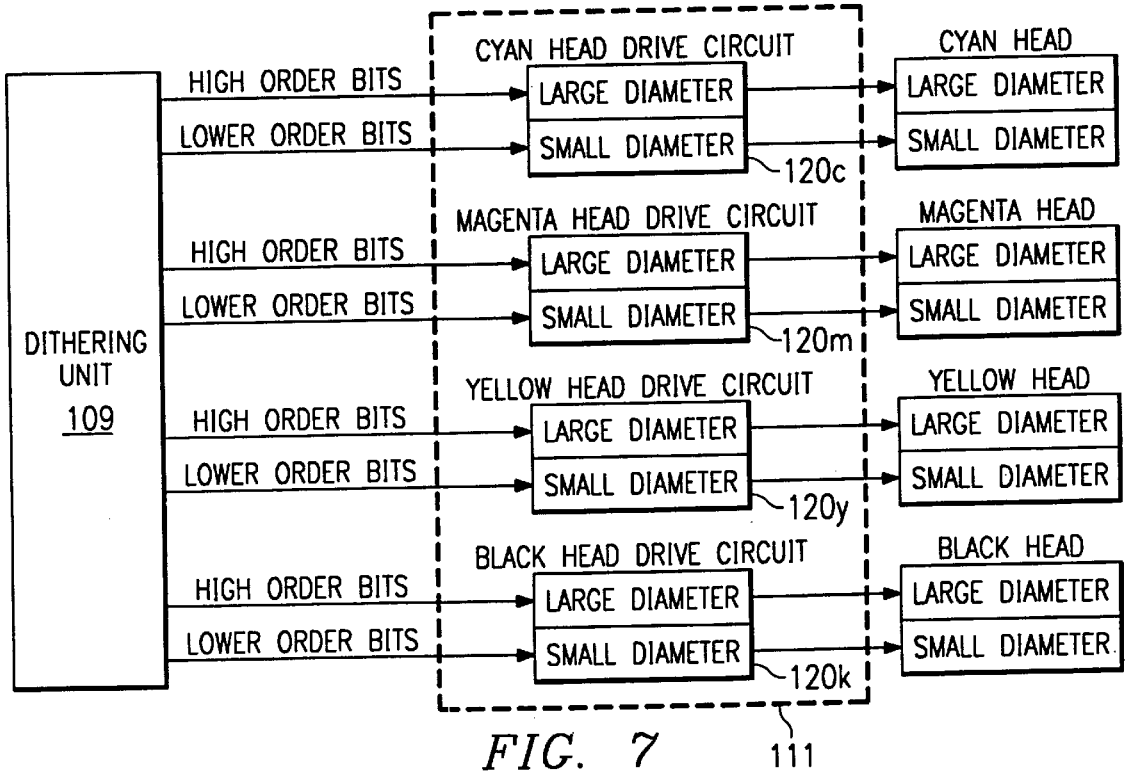
FIG. 7 is a block diagram showing the specific construction of dithering unit 109 and head drive unit 111 of FIG. 5.

FIG. 7 is a block diagram showing details of head drive unit 111 and dithering unit 109 of FIG. 5. Referring to the drawing, dithering unit 109 outputs high order bit data and low order bit data as shown in FIG. 6 for each color cyan, magenta, yellow, and black in order to print one dot.

Head drive unit 111 includes cyan head drive circuit 120*c*, magenta head drive circuit 120*m*, yellow head drive circuit 120*y*, and black head drive circuit 120*k*. These head drive circuits 120*c*, 120*m*, 120*y*, and 120*k* each include the large diameter nozzle drive circuit and the small diameter nozzle drive circuit. The high order bit data are input to the large diameter nozzle drive circuit, and the low order bit data are input to the small diameter nozzle drive circuit.

Each drive circuit 120*c*, 120*m*, 120*y*, and 120*k* is connected to its respective printhead which accommodates the appropriate color ink. As previously mentioned, these printheads each include a large diameter nozzle and a small diameter nozzle. The large diameter nozzle corresponds to nozzle 28 of the first head section 52 shown in FIG. 2, and the small diameter nozzle corresponds to the nozzle 28 of the second head section 51 of FIG. 2. Each drive circuit is provided with a pulse power source and a control unit for the pulse power source. The control unit operates with the pulse power source to output a predetermined pulse voltage in accordance with the specific image data.

The large diameter nozzle drive circuit and small diameter nozzle drive circuit, including the head drive circuits 120*c*, 120*m*, 120*y*, and 120*k*, apply voltages to the piezoelectric elements to drive the large diameter nozzle and small diameter nozzle of the heads corresponding to the respective colors. As previously described, the volume of the ink cavity is reduced by a deformation of the piezoelectric element which occurs in response to the application of a voltage. The result is to cause a discharge of ink.

Figure 8:
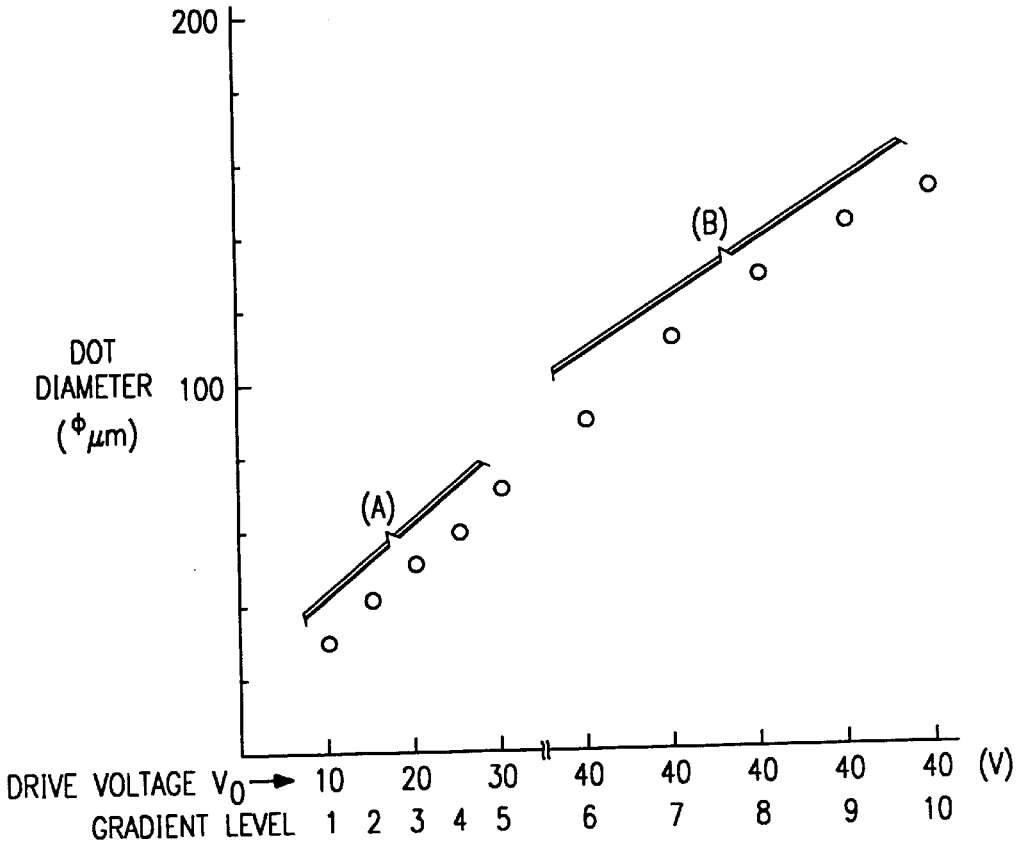
FIG. 8 illustrates the dot gradient control in the mode of the first embodiment.

FIG. 8 is a graph illustrating dot diameter and the gradient level of the dots printed by the inkjet printer of the present embodiment of the invention. Referring to the drawing, the horizontal axis of the graph represents the dot gradient level (i.e., gradient levels 1–10) and the vertical axis represents the diameter of the dot printed at the specified gradient level (units: gm). The plotted dot diameter is the diameter of a dot when printed on a sheet.

In the graph, the small diameter range indicated by zone (A) corresponds to the range of ink dot sizes discharged by nozzle 28 of the second head section 51. The large diameter range indicated by zone (B) corresponds to the range of ink dot sizes discharged by nozzle 28 of the first head section 52.

In the small diameter range (A), the dot gradient size is selected by controlling the amplitude of the applied voltage. In contrast, the dot gradient size is selected in the large diameter range (B) by controlling the pulse number of the applied voltage.

Figure 9:
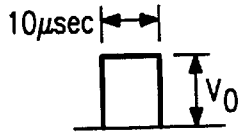
FIG. 9 illustrates the voltage value control executed in the small diameter range of FIG. 8.

More specifically, for the small diameter range (A),, the magnitude of the applied voltage Vo is varied for each dot gradient, however the voltage pulse time for each of the small diameter dot gradient levels is identical (e.g., 10 $\mu$sec in all cases). The applied voltage for the small diameter range is illustrated in FIG. 9.

In the present embodiment, the voltage value Vo is 10 V at gradient level 1, 15 V at gradient level 2, 20 V at gradient level 3, 25 V at gradient level 4, and 30 V at gradient level 5. These values correspond to the graph shown in FIG. 8. The voltage application time is 10 $\mu$sec in each of the above cases.

Figure 12:
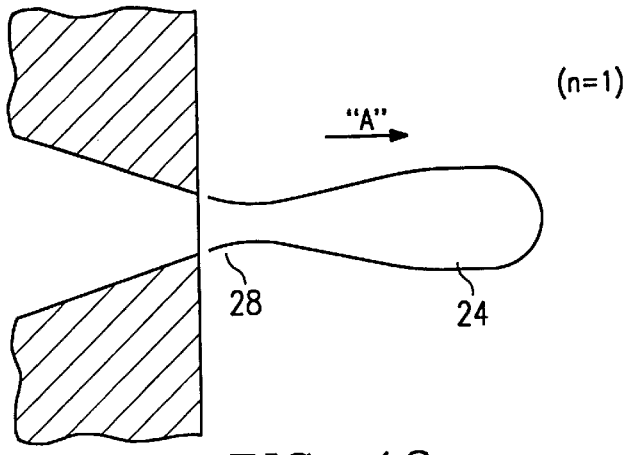
FIG. 12 illustrates the state of the ink near the nozzle when a first pulse is applied to the piezoelectric element of the inkjet printhead.
Figure 13:
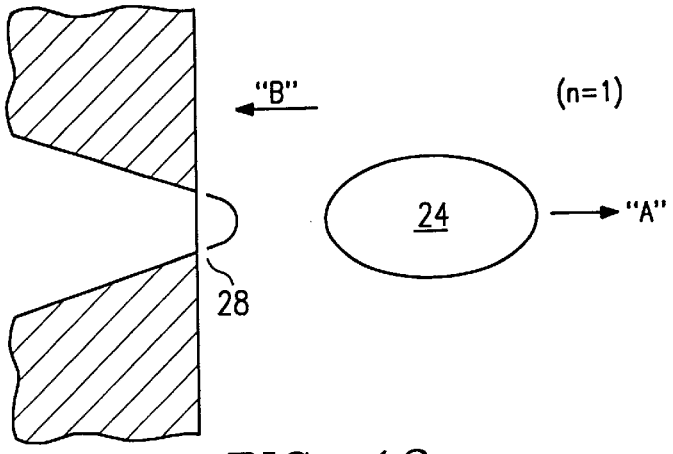
FIG. 13 shows the state of the ink shortly after the time depicted in FIG. 12.

The relationship between the voltage application and ink discharge based on voltage value control is described below. Referring now to FIG. 12, in the voltage value control the volume of the ink cavity is reduced when the Vo voltage is applied to the piezoelectric element, thereby causing ink 24 to discharge from small diameter nozzle 28 in the discharge direction "A". After the voltage application ends, the piezoelectric element recovers from its deformed condition and returns to its original condition. Thus, the volume of the ink cavity is increased from the state shown in FIG. 12. As shown in FIG. 13, when the ink cavity volume returns to the original state, the ink attempts to return to the small diameter nozzle 28 in the return direction "B". Due to the surface tension of the ink, the discharging part of the ink 24 separates from the returning ink and continues away from the nozzle in the discharge direction "A" as shown in FIG. 13. The ink is thus discharged to the print sheet to which it adheres thereby printing a dot.

The above described method is used in the present embodiment to print small diameter dots. In contrast, a pulse number control method is used to print dots for the large diameter dot range. In the pulse number control method, the amplitude of the pulse voltage applied to the piezoelectric element remains constant, however, the number of pulses is controlled to control the quantity of ink discharged from the nozzle.

Figure 10:
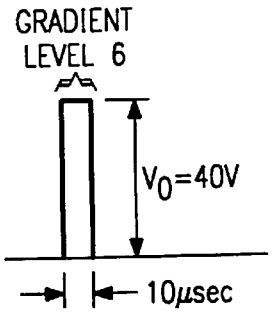
FIG. 10 illustrates the pulse form used at gradient level 6 of FIG. 8.
Figure 11:
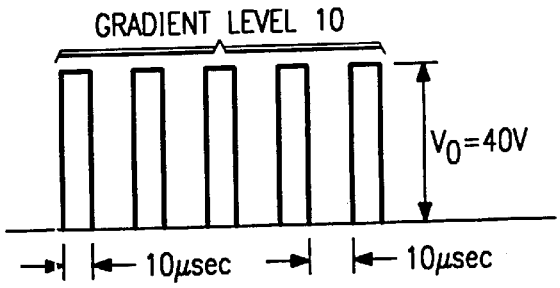
FIG. 11 illustrates the pulse form used at gradient level 10 of FIG. 8.

FIGS. 10 and 11 contrast the drive method for small diameter dots and large diameter dots. For the highest gradient of the small diameter dots, a single voltage pulse is applied to the piezoelectric element as shown in FIG. 10. There, a voltage Vo of 40 V is applied for 10 $\mu$sec for gradient level 6. Referring to FIG. 11, for the large diameter dots at gradient level 10, the same pulse amplitude and pulse time is applied as shown in FIG. 10, but five consecutive pulses each 10 $\mu$sec apart are applied.

By varying the number of pulses, the various gradient levels for the large diameter dots are achieved. Specifically, two pulses are output at gradient level 7, three pulses are output at gradient level 8, and four pulses are output at gradient level 9. The net result is that although pulses having the same voltage value as in FIG. 10 are used, the quantity of discharged ink may be controlled by the number of pulses. This pulse number control thereby controls the diameter of the printed dot.

Figure 14:
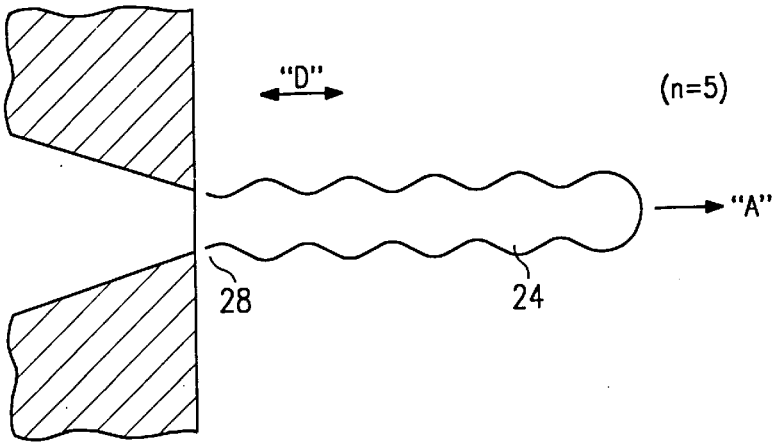
FIG. 14 illustrates the state of the ink near the nozzle when five individual voltage pulses are rapidly applied to the piezoelectric element of the inkjet printhead.

The discharge of ink based on pulse number control is described further below with reference to FIG. 14. For example, when printing dots at gradient level 10, five pulses are applied to the piezoelectric element as shown in FIG. 11. This causes the volume of ink cavity 26 to contract and expand five times. Thus, the ink 24 discharged from the large diameter nozzle 28 moves in the direction of arrow "D" in FIG. 14 as ink is repeatedly pushed from nozzle 28 in the discharge direction and returned, such that an ink drop having the form of five nodes is discharged from the nozzle in the discharge direction "A". The effect is that the quantity of discharged ink is controlled by the length of the ink drop in the pulse number control, as shown in FIG. 14.

In the above-described first embodiment, dot diameter control is accomplished for a dot range of about 35–160 μm, as shown in FIG. 8. By using the approach of the first embodiment it is unnecessary to apply a high voltage to the piezoelectric element in order to print large diameter dots, thereby simplifying voltage control. Furthermore, the electrical circuits and boosters necessary to apply a high voltage are avoided, thereby providing an inexpensive inkjet printer.

In regard to dot size dispersion, conventional drive methods using only voltage control for generation of large diameter dots (range (B) of FIG. 8) generate dots having a diameter dispersion of about +/−10%. In contrast, the drive method of the first embodiment achieves a dot diameter dispersion of less than +/−5% when controlling the large diameter dot range of (B) of FIG. 8 by pulse number control. Thus, dot diameter can be more accurately controlled and print quality improved by the mode of the present embodiment.

Figure 15:
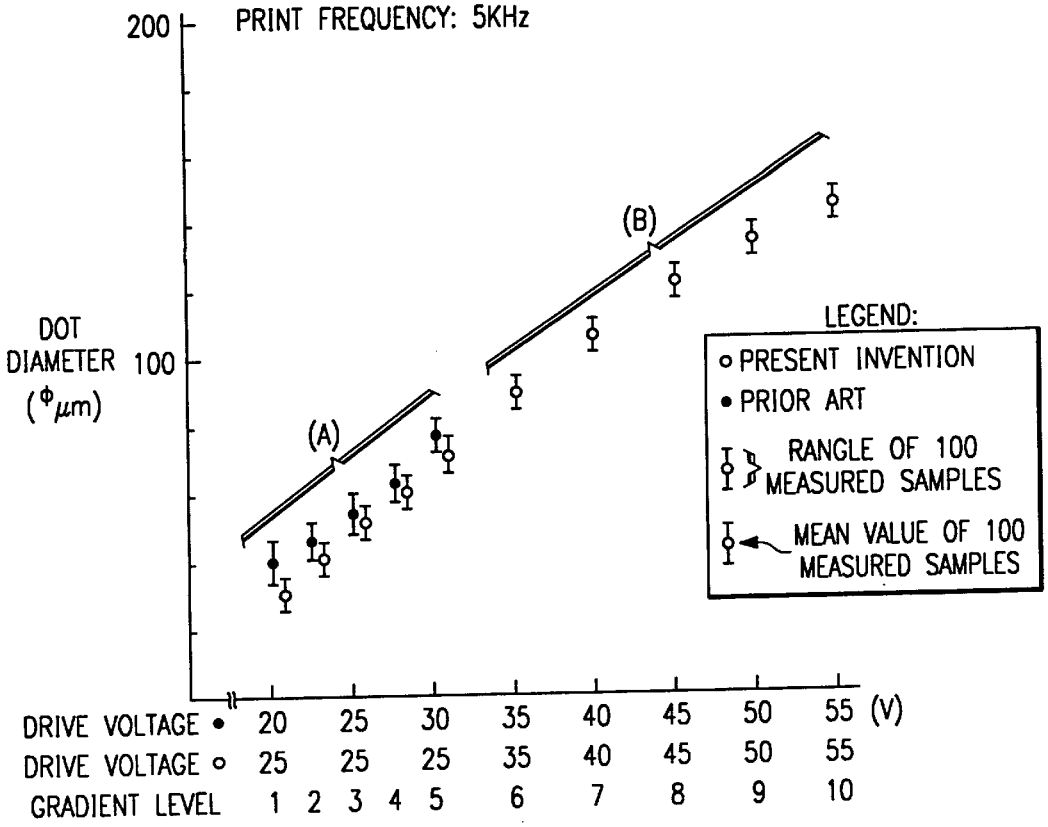
FIG. 15 illustrates the inkjet printer drive results in the mode of a second embodiment of the present invention.

FIG. 15 is a graph showing the gradient levels and dot diameters printed by an inkjet printer of a second embodiment of the present invention. In FIG. 15, the horizontal axis of the graph represents the dot gradient levels and the corresponding voltage applied to the piezoelectric element for each level. The vertical axis of the graph represents the diameter of the dot adhered to a print sheet (units: μm). In the graph, plotted points are shown for both the drive control of the present embodiment, as well as for drive control by conventional art which is used for comparison purposes. Each plotted point represents the mean value of 100 measured samples, and the top and bottom lines fixed above and below the plotted points represent the dispersion range of the 100 measured values.

Referring to the drawing, data for the present embodiment gradient levels 1–5 were printed by the small diameter nozzle, which is identified as the small range (A) on the graph, and gradient levels 6–10 were printed by the large diameter nozzle, which is identified as the large range (B) on the graph.

In the second embodiment, pulse number control is used in the small diameter range, and voltage control is used in the large diameter range. That is, the applied voltage remains constant for dots at gradient levels 1–5, and gradient control is accomplished by controlling the number of applied pulses.

In contrast, at gradient levels 6–10, the time of voltage application to the piezoelectric element remains the same, and gradient control is accomplished by changing the applied voltage between 35–55V.

In contrast to the present invention, drive control of the conventional art applies different amplitude voltage pulses to produce dots for gradient levels in the small diameter range (Vo in the range of 20–30V) just as different amplitude voltage pulses are used to produce dots for gradient levels in the large diameter range.

Figure 16:
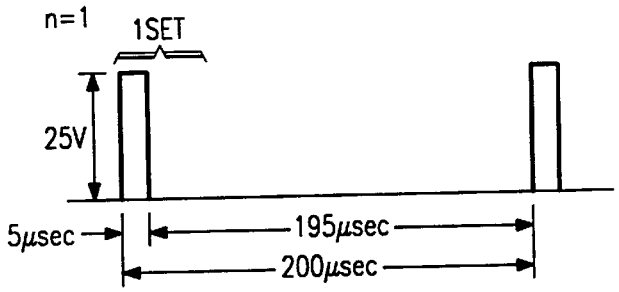
FIG. 16 illustrates the voltage pulse applied at gradient level 1 of FIG. 15.

In the present invention, when printing gradient level 1 dots, a voltage is applied to the piezoelectric element as shown in FIG. 16. Referring to FIG. 16, a voltage of 25 V is applied to the piezoelectric element as a 5 μsec pulse voltage. 195 μsec after first the pulse voltage is applied, a subsequent pulse voltage is applied to print the next dot. That is, the time interval between the rise of a pulse voltage to print one dot until the rise of a pulse voltage to print the next dot is 200 μsec. Printing control is therefore accomplished at a print frequency of 5 kHz.

Figure 17:
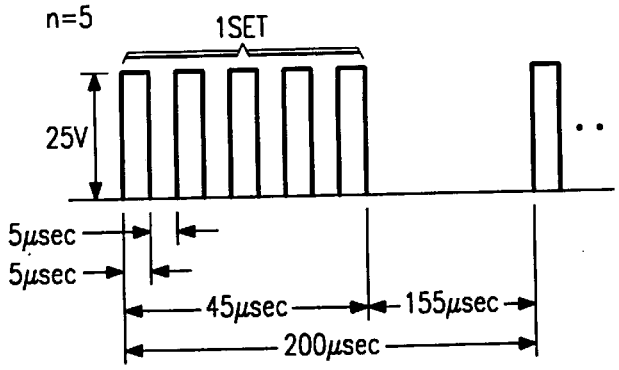
FIG. 17 illustrates the voltage pulse applied at gradient level 5 of FIG. 15.

On the other hand, the voltage applied to a piezoelectric element at gradient level 5 is shown in FIG. 17. Referring to FIG. 17, a pulse of 5 μsec at 25 V (identical to one pulse of FIG. 16) is applied five times to the piezoelectric element to print a single dot. The time interval between the fall and rise of an individual pulse is 5 μsec, therefore, a time of 45 μsec is required to print a dot at gradient level 5.

As with printing at gradient level 1, at gradient level 5 there is a time interval of 200 μsec from the rise of an initial pulse voltage to print one dot to the rise of an initial pulse voltage to print the next dot. Therefore, the print frequency is maintained at 5 kHz.

Figure 18:
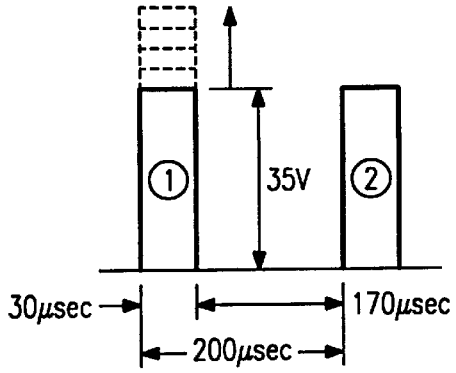
FIG. 18 illustrates the voltage value control in the large diameter range of FIG. 15.

At gradient levels 6–10, however, dot diameter control is accomplished by changing the amplitude of the applied voltage. That is, referring to FIG. 18, a voltage corresponding to the dot to be printed is applied to the piezoelectric element for a time of 30 μsec. In this embodiment, the applied voltage is 35 V at gradient level 6, 40 V at gradient level 7, 45 V at gradient level 8, 50 V at gradient level 9, and 55 V at gradient level 10.

In the voltage value control, the time interval is also 200 μsec between the rise of a pulse voltage to print one dot and the rise of the pulse voltage to print the next dot. Therefore, the print frequency is also 5 kHz in the voltage value control.

As shown in FIGS. 16 and 17, the time a single pulse is applied in the pulse number control of the present embodiment is 5 μsec, and this value is determined based on the information discussed below.

Figure 19:
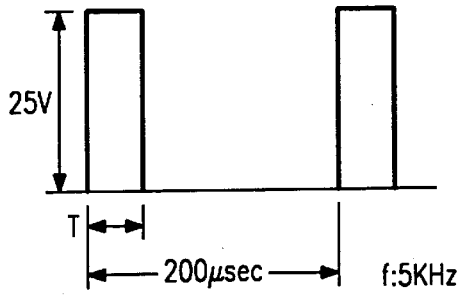
FIG. 19 shows the pulse width "T" of the applied voltage pulse.
Figure 20:
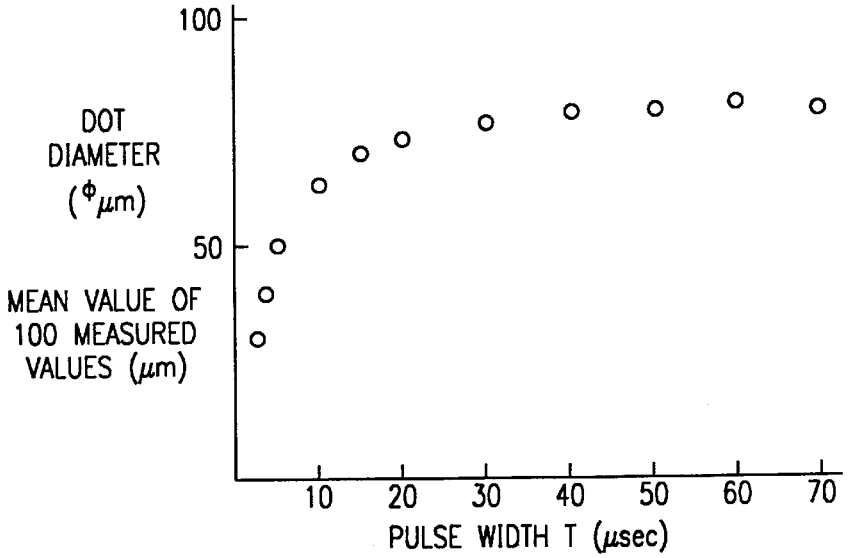
FIG. 20 shows the relationship between the pulse width T and the adhered dot diameter.

Dot diameter may also be controlled by varying the duration of the voltage pulse. Experimental results from such an approach follow. Referring to FIG. 19, a printhead was driven with a 25 V pulse applied to a piezoelectric element of an inkjet printhead where the print frequency was set to 5 kHz. For this data, the pulse duration time (pulse width) of application of a single pulse is designated T, and for the experiment the dot diameter was measured experimentally when the value of T was varied. The relationship between pulse width T (units: μsec) and the diameter (units: μm) of the dot adhered to the print sheet is shown in FIG. 20. For each plotted point, the diameter of the adhered dot is a mean value of 100 measurements.

Referring to the graph of FIG. 20 is should be noted that for values of pulse width T from approximately 5–20 μsec the adhered dot diameter increases with increasing pulse time. However, when the pulse width T exceeds approximately 20 μsec, the diameter of the adhered dot ceases to further increase by any significant amount. This indicates there is no further deformation of the piezoelectric element even when a pulse voltage is applied to the piezoelectric element for a time longer than 20 μsec.

It can be understood from the experimental results that the pulse width T may have a maximum value of about 15 μsec in this particular embodiment. When the piezoelectric element is driven with a pulse width less than 15 μsec, the possible range of the dot diameter control is larger, so as to provide for an inkjet printer capable of printing more halftones. Accordingly, in the present embodiment, the pulse width T is set at 5 μsec in the pulse number control to drive the piezoelectric elements.

Figure 21:
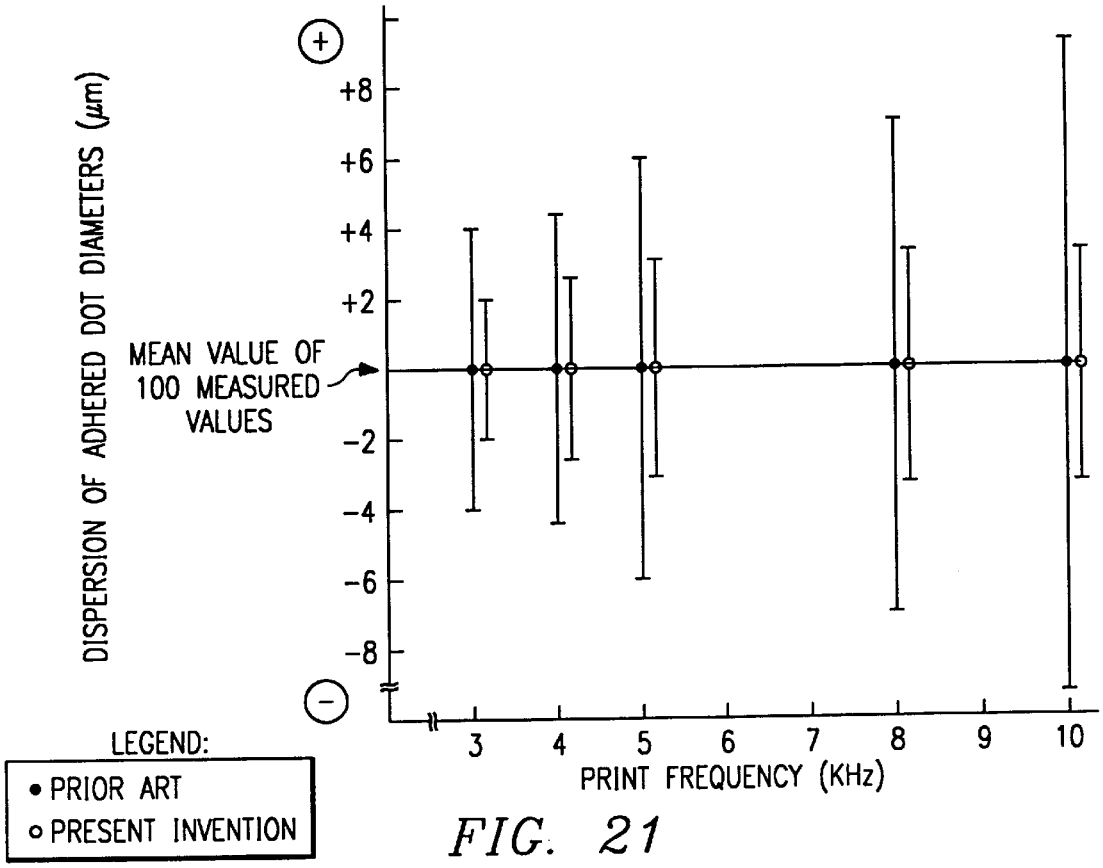
FIG. 21 shows the relationship between the print frequency and the dispersion of the adhered dot diameter.

FIG. 21 is a graph illustrating the dispersion of adhered dot diameters and the print frequency contrasting the present embodiment of the current invention and a conventional print drive. The graph shows the print frequency (units: kHz) on the horizontal axis, and the dispersion in adhered dot diameters (units: μm) from a mean value on the vertical axis.

For each plotted point, the plotted data is the measured dispersion over 100 measured values. For each print frequency, data from the current invention is plotted together with data from a prior art printhead for comparison. The graph shows the result of printing dots at gradient level 3 of FIG. 15 for varying print frequencies.

Figure 22:
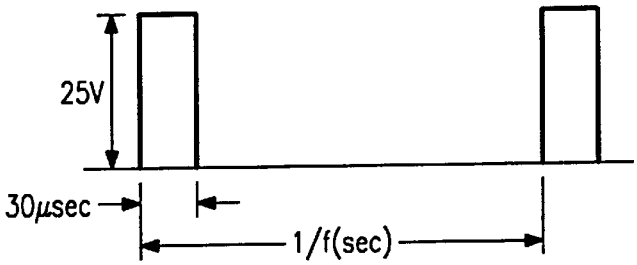
FIG. 22 (PRIOR ART)
FIG. 22 illustrates the method of applying a voltage pulse to a piezoelectric element in the conventional art.

More specifically, in the conventional art drive method, a pulse voltage of 25 V was applied to a piezoelectric element for a duration of 30 μsec as shown in FIG. 22. The pulse voltage was repeated at a frequency rate of f. Hence the time period between pulses was equal to 1/f (where f is the print frequency).

Figure 23:
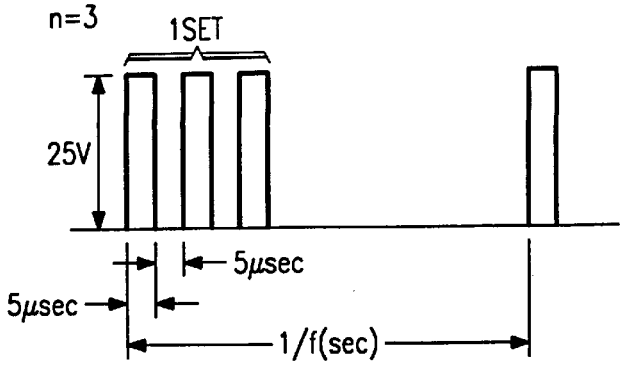
FIG. 23 illustrates the method of applying a voltage to a piezoelectric element in the mode of the present invention.

In contrast, for the present invention the applied voltage was three 5 μsec pulses, each at an amplitude of 25 V, which were applied in one set. The set of three pulses was repeated at a frequency rate of f. Hence the time period between sets of three pulses was equal to 1/f as shown in FIG. 23. The time between the fall and rise of each pulse within one set was 5 μsec.

Referring to FIG. 21, the experimental results indicate a smaller dispersion of the adhered dot diameter under the drive control of the present embodiment as compared to the drive control of the conventional art at all print frequencies. For the conventional art, the dispersion increased in conjunction with increasing print frequency. In the present embodiment, however, the dispersion remained relatively unchanged even when the print frequency was increased. The dot diameter dispersion was particularly suppressed in the inkjet printer of the present embodiment when driving the printhead at print frequencies of 5 kHz and greater. This reduced dispersion in the present embodiment is believed to be due to the reduction of the influence of sloshing of the ink within the ink cavity by controlling the dot diameter via the number of pulses.

In other respects, the adhered dot diameter of the present embodiment was smaller than the adhered dot diameter of the conventional art (refer to FIG. 15). This dot compactness allows finer dots to be printed so as to allow printing of higher resolution graphics in the present embodiment.

A drive circuit wherein control is accomplished by varying the number of pulses while maintaining a fixed drive voltage as previously described can be manufactured easily and relatively inexpensively so as to allow for the design of a low cost inkjet printer.

Figure 24:
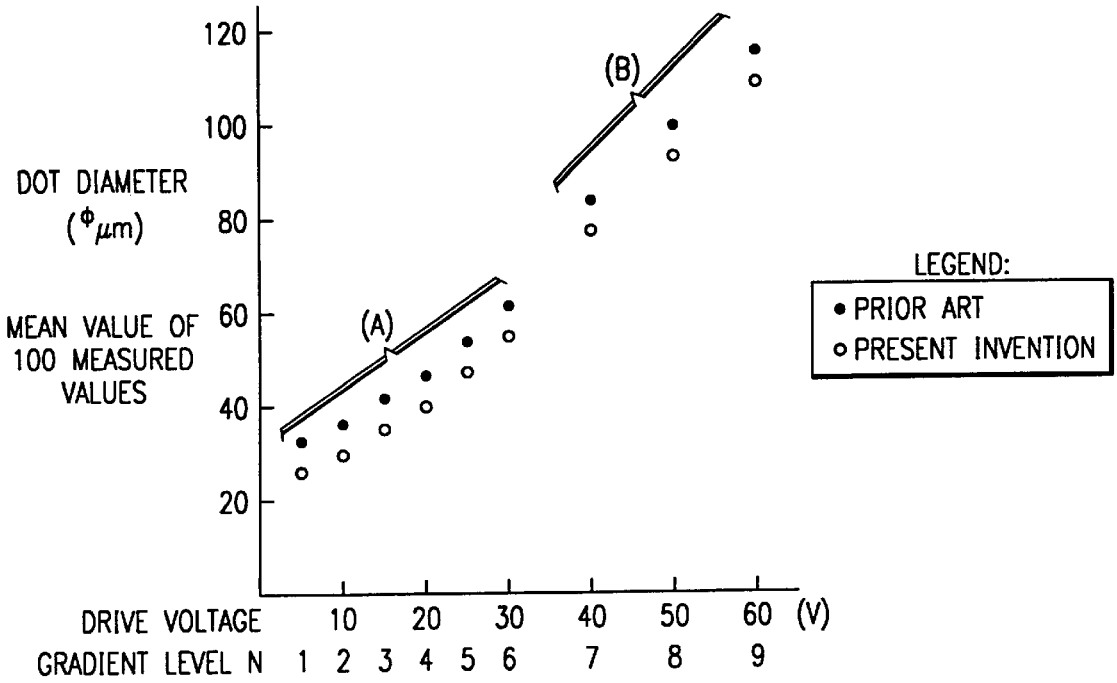
FIG. 24 illustrates the inkjet printer drive results based on the method of controlling the inkjet printer in the mode of a third embodiment of the present invention.

FIG. 24 is a graph illustrating the relationship between the diameter of dots adhered on a print sheet and the gradient of the dot printed by the inkjet printer of a third embodiment. Referring to the drawing, the graph shows the dot gradient level (i.e., gradient levels 1–9) and the corresponding voltage value on the horizontal axis, and shows the diameter (units: μm) of the dot adhered on a print sheet on the vertical axis. For each plotted point, the adhered dot diameter is the mean value of 100 printings.

In the graph, data for both the present invention and prior art are shown. For the prior art, the printing of dots of nine gradient levels was accomplished by changing the voltage value of pulses having the same waveform.

In the control of the present embodiment, in comparison, dots of gradient levels 1–6 were printed by discharging ink from a small diameter nozzle, and dots of gradient level 6–9 were printed by discharging ink from a large diameter nozzle. A key feature of the present embodiment is that the waveform of the voltage applied to the piezoelectric elements of the small diameter nozzle differs from the waveform of the voltage applied to the piezoelectric element of the large diameter nozzle.

Figure 25:
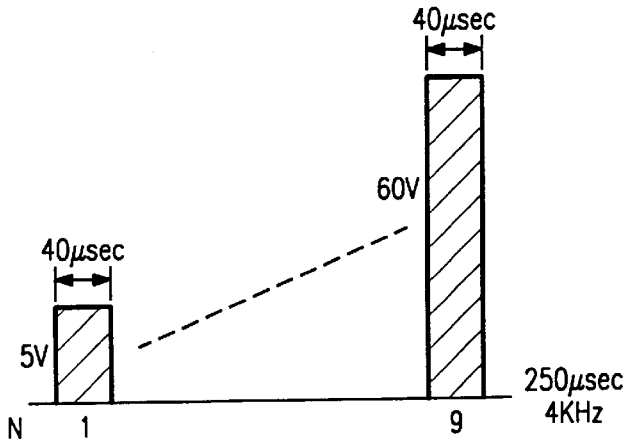
FIG. 25 (PRIOR ART)
FIG. 25 illustrates the dot diameter voltage value control of the conventional art.

That is, in the conventional art, for gradient levels from level 1 to 9, the voltage waveform is the same and only the voltage amplitude differs as shown in FIG. 25. For gradient level 1, a 5 V voltage is applied for 40 μsec, and at gradient level 9, a 60 V voltage is applied for 40 μsec. At gradient levels 2–8, pulses having the voltage values shown on the horizontal axis of the graph of FIG. 24 were applied. For the data corresponding to the conventional art shown in FIG. 24, there was a time interval of 250 μsec from the rise of a pulse to print one dot to the rise of a pulse to print the next dot. Accordingly, the print frequency is 4 kHz.

Figure 26:
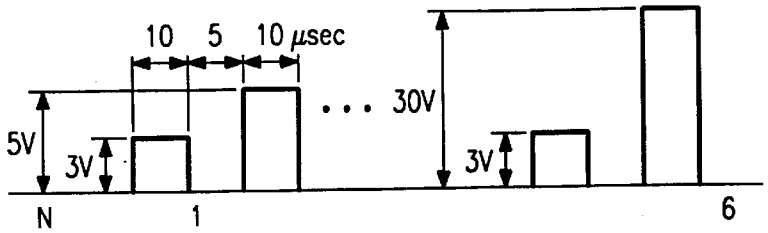
FIG. 26 shows the pulse form applied for gradient levels 1–6 of FIG. 24.

In contrast to the above, the present embodiment employs a drive control using a pulse of the type shown in FIG. 26 for printing with the small diameter nozzle of range (A) of FIG. 24.

The pulse as shown in FIG. 26 has a prepulse and a main pulse. At gradient level 1, a 3 V pulse is applied to the piezoelectric element for 10 μsec as a prepulse. Then, after a 5 μsec delay, a 5 V main pulse is applied for 10 μsec.

In this embodiment, the application time of the prepulse voltage and the main pulse voltage is the same for each gradient level 1–6. The application time of the main pulse is 10 μsec for gradient levels 1–6, but the main pulse voltage amplitude is varied between 5–30 V for gradient levels 1–6 as shown on the horizontal axis in FIG. 24.

Figure 27:
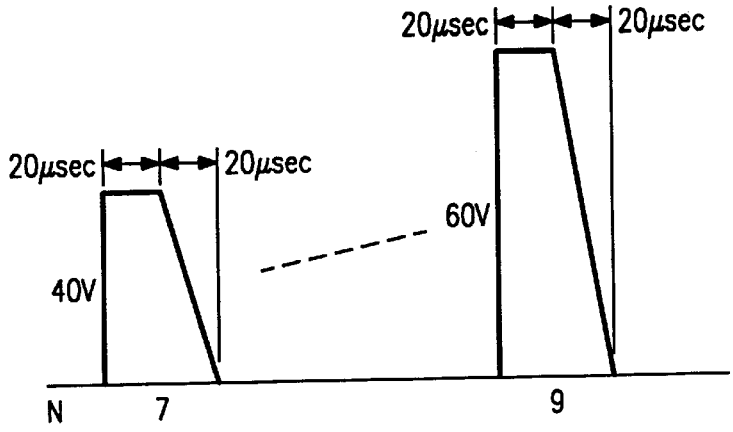
FIG. 27 shows the pulse form applied for gradient levels 7–9 of FIG. 24.

The pulse applied to the piezoelectric element of the large diameter nozzle shown in range (B) of FIG. 24 has the waveform shown in FIG. 27. This pulse has a characteristic fixed decay period for the falling part of the waveform, and will be referred to hereinafter as a waveform having a trapezoidal-like shape. That is, the time required for the pulse to fall is longer than the time required for the pulse to rise. Furthermore, the time required for the pulse to rise is near zero, and the time required for the pulse to fall is constant even for varying peak amplitudes.

For example, at gradient level 7, a 40 V voltage is applied for 20 μsec, and between 20–40 μsec the voltage drops from 40 V to zero. Between gradient levels 7–9, the time of maximum voltage value is 20 μsec in all cases, and the time required for the voltage to drop is uniformly 20 μsec in all cases. The maximum voltage value of the pulse at gradient levels 7–9 changes within a range of 40–60 V as shown in FIG. 24.

In the range of printing by the small diameter nozzle, the piezoelectric element is slightly expanded by the prepulse to increase the pressure on the ink by using the voltage application method of the present embodiment. This increased pressure produces a rolling wave in the ink. This movement of the ink stabilizes the discharge direction of the ink from the small diameter nozzle, and reduces phenomena causing adverse affects on printing such as satellites. Moreover, after a drop of ink is discharged, intake of air from the large diameter nozzle is prevented by using the waveform having a trapezoidal-like shape as is illustrated in FIG. 27.

Therefore, by using the above described approach for driving the large diameter nozzle, dot diameter dispersion is reduced, responsiveness is improved, and satellites and dot splitting are reduced. For the small diameter nozzle, dot diameter dispersion is reduced, and curves and satellites are also reduced.

Referring to FIG. 24, it can be seen that the present embodiment is capable of printing dots having a diameter which is smaller than that produced by the conventional art. As a result, a printer using the present invention is capable of printing higher resolution graphics.

Figure 28:
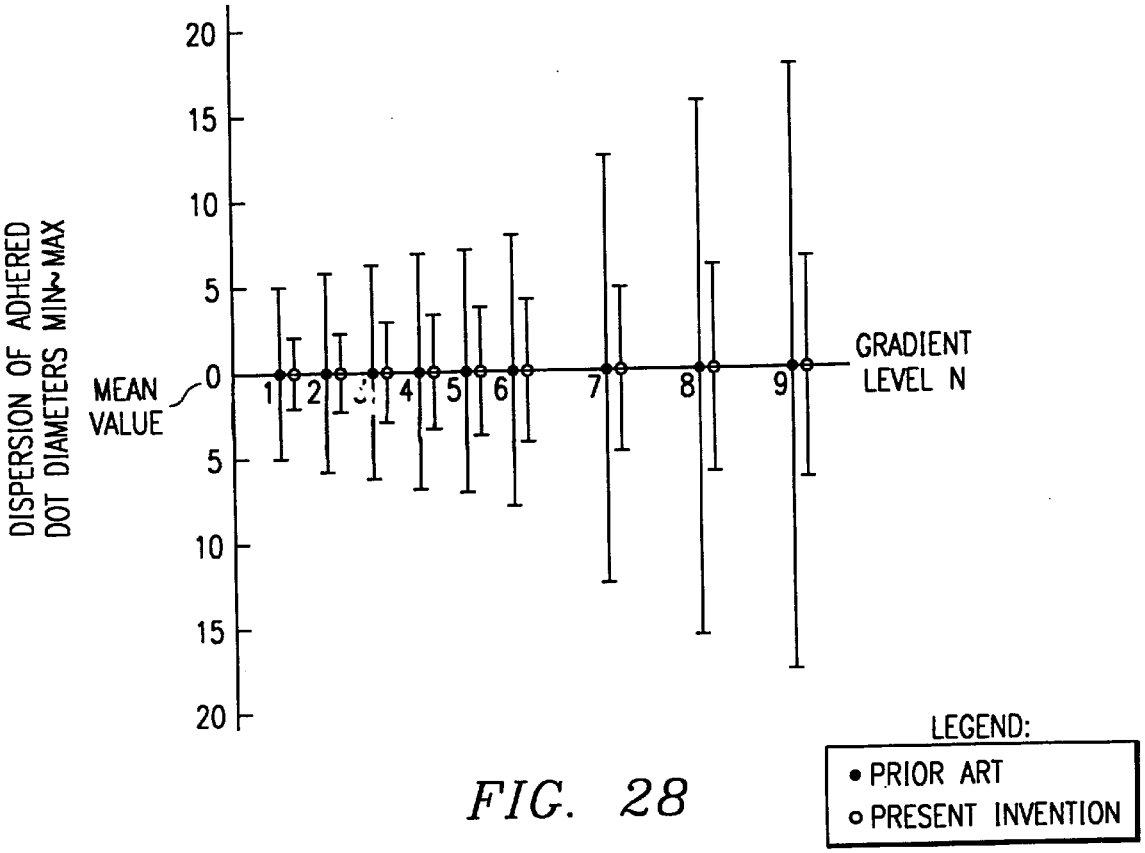
FIG. 28 illustrates the effect of the present invention at reducing dot size dispersion over the prior art.

FIG. 28 is a graph showing the effectiveness of the present embodiment at reducing dot size dispersion. In the graph, the horizontal axis represents the gradient level (N) of the dots printed by the inkjet printer, and the vertical axis represents the printed dot size dispersion. For each plotted point the vertical bars represent the range of dot sizes measured from a sample of 100 printed dots. For comparison purposes, data from both an embodiment of the present invention as well as from a conventional printer are shown.

Referring to FIG. 28 it can been seen that for all gradient levels the dispersion of dot size by the present embodiment is smaller than the dispersion of dot size from a printer of the conventional art. This data illustrates that greater precision in dot diameter control is provided in the present embodiment.

Figure 29:
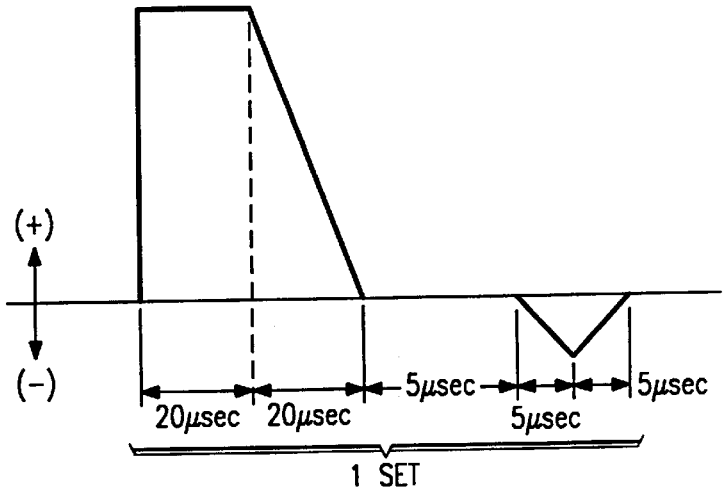
FIG. 29 illustrates a modification to the voltage pulse of the third embodiment.

A variation on the third embodiment of the present invention is described next. In this variation, the voltage waveform applied to the piezoelectric element of the large diameter nozzle may be the waveform as shown in FIG. 29. Referring to the drawing, the voltage waveform of the large diameter nozzle has a segment of maximum applied voltage for 20 μsec and a falling segment for 20 μsec similar to that of the prior embodiment as shown in FIG. 27. However, five μsec after the falling pulse ends, there is a voltage drop to the negative side for 5 μsec, then a voltage rise to the positive side for 5 μsec, producing a triangular wave.

Figure 30:
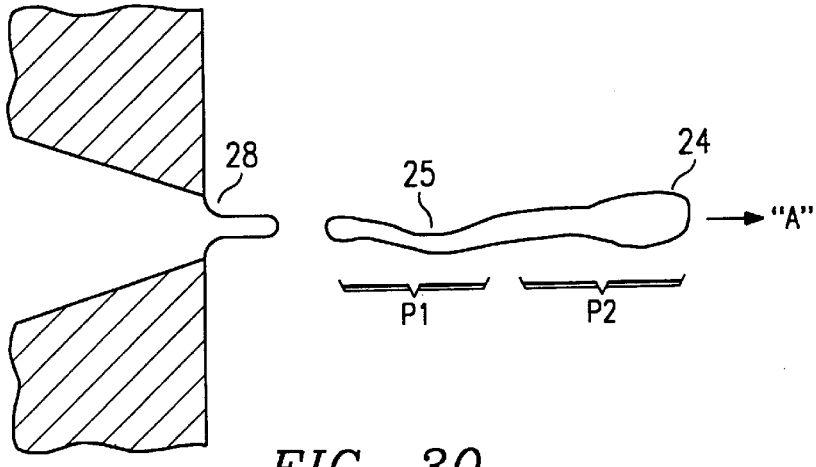
FIG. 30 illustrates several problems associated with inkjet discharge.
Figure 31:
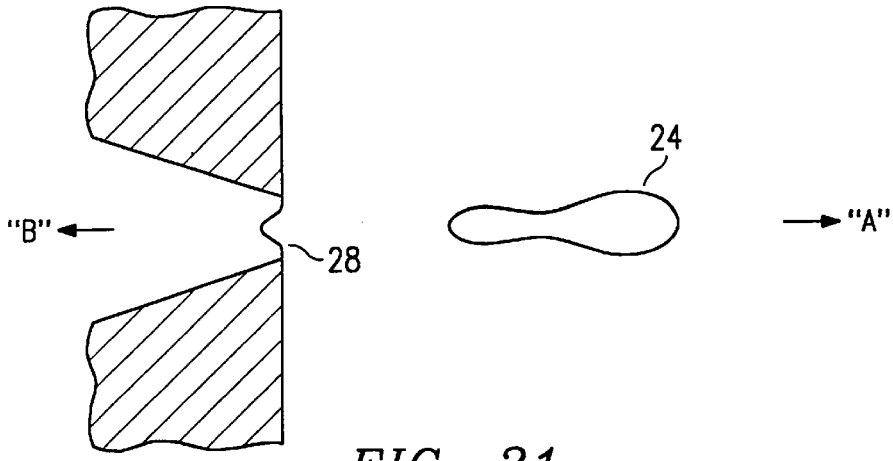
FIG. 31 shows the state of the ink when the pulse shown in FIG. 29 is applied to the piezoelectric element of the inkjet printhead.
Figure 32A:
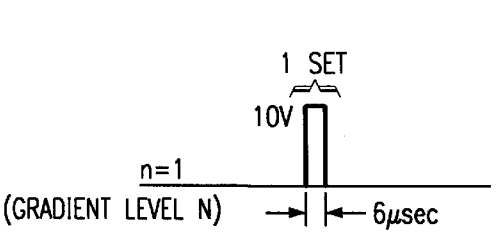
FIGS. 32(*a*)–32(*i*) illustrate the pulses which are applied to a piezoelectric element in an inkjet printer of a fourth embodiment of the present invention for each of the nine graduation levels.
Figure 32B:
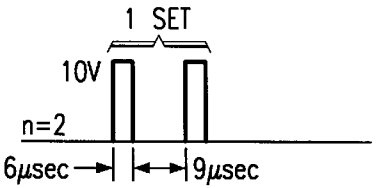
Figure 32C:
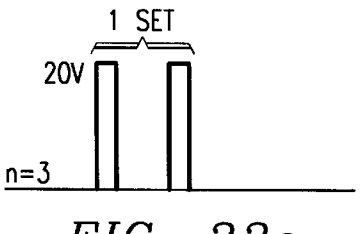
Figure 32D:
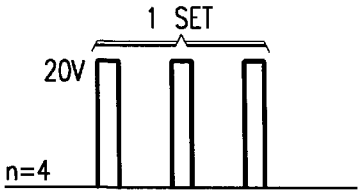
Figure 32E:
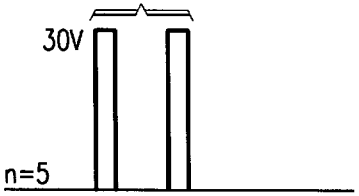
Figure 32F:
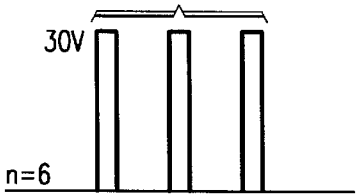
Figure 32G:
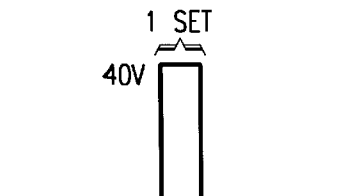
Figure 32H:
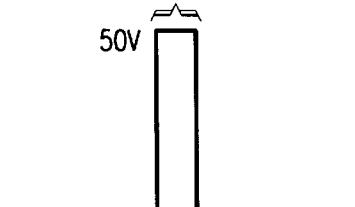
Figure 32I:
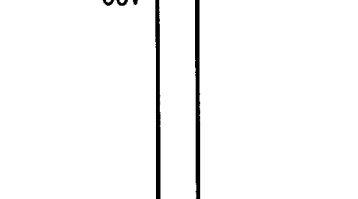

The drive approach of the third embodiment with and without this variation in waveform are contrasted in FIGS. 30 and 31. As shown in FIG. 30, an ink drop shortly after being discharged from the nozzle tends to be elongated. When using the drive approach with the unmodified waveform of FIG. 27, as the elongated drop moves away from the nozzle, the drop tends to constrict in the region of the tail under the force of surface tension. This constricting region is indicated as 25 in FIG. 30. As the drop continues to move away from the nozzle it also continues to deform under the force of surface tension and the constriction 25 narrows until the ink drop divides into two drops, segment P1 and segment P2. At this time, segment P1 forms a curve drop, and produces a satellite on the print sheet, i.e., an unintended second printed dot.

Referring now to FIG. 31, when the printer is driven using the waveform of FIG. 29, after the ink is discharged a small negative pressure is generated in the return direction toward the ink cavity, i.e., the "B" direction of FIG. 31. As a result, the drop more cleanly separates from the nozzle, and the constricting region which tends to divide the drop is prevented. As a result, production of the curve drop is suppressed.

A fourth embodiment of the present invention is described next. FIGS. 32(*a*)–32(*i*) show the voltage waveforms applied to the piezoelectric element for each of the nine gradient levels to be printed. For gradient levels 1–6, printing of dots is accomplished by the small diameter nozzle. For gradient levels 7–9, printing of dots is accomplished by the large diameter nozzle.

A summary of the waveforms shown in FIGS. 32(*a*)–32(*i*) is as follows:

Gradient level 1: A single voltage pulse of 10 V is applied for 6 μsec;

Gradient level 2: Two sequential voltage pulses are applied, each pulse at 20V for 6 μsec with an interval of 9 μsec between them;

Gradient level 3: Two sequential voltage pulses are applied, each pulse at 20V for 6 μsec with an interval of 9 μsec between them;

Gradient level 4: Three sequential voltage pulses are applied, each pulse at 20V for 6 μsec with an interval of 9 μsec between them;

Gradient level 5: Two sequential voltage pulses are applied, each pulse at 30V for 6 μsec with an interval of 9 μsec between them;

Gradient level 6: Three sequential voltage pulses are applied, each pulse at 30V for 6 μsec with an interval of 9 μsec between them;

Gradient level 7: A single voltage pulse of 40V is applied for 35 μsec;

Gradient level 8: A single voltage pulse of 50V is applied for 35 μsec; and

Gradient level 9: A single voltage pulse of 60V is applied for 35 μsec.

In the fourth embodiment, for gradient levels 1–6, which correspond to the range of the small diameter nozzle, printed dot diameter is controlled by changing both the pulse number and the pulse voltage value. In contrast, for gradient levels 7–9, which correspond to the range of the large diameter nozzle, the dot diameter is controlled only by the pulse voltage. These dot diameter controls are readily accomplished and provide an inkjet printer which produces superior print quality.

Figure 33:
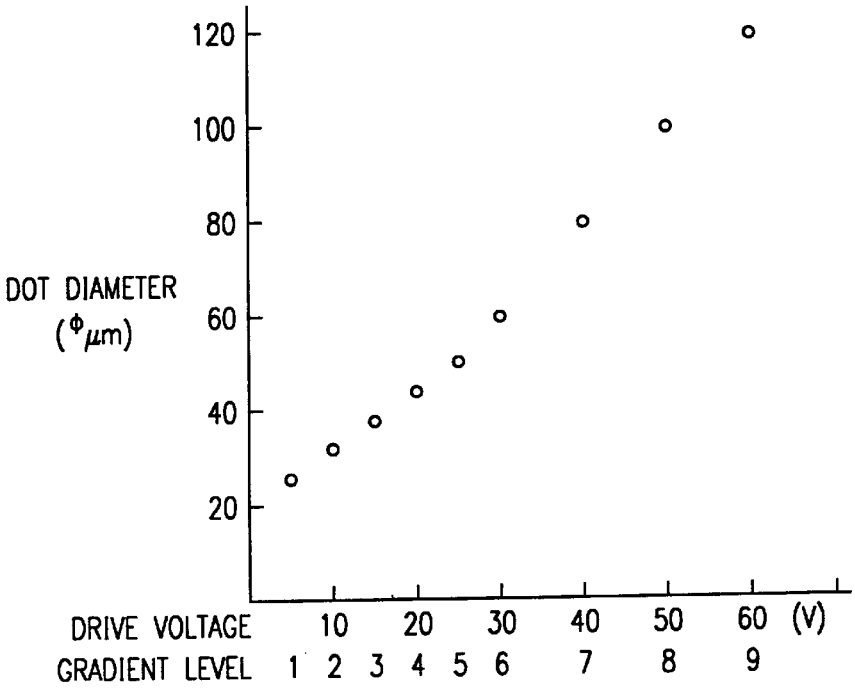
FIG. 33 graphs the adhered dot diameter for graduation levels one through nine when the pulses of FIGS. 32(*a*)–32(*i*) are applied.
Figure 35:
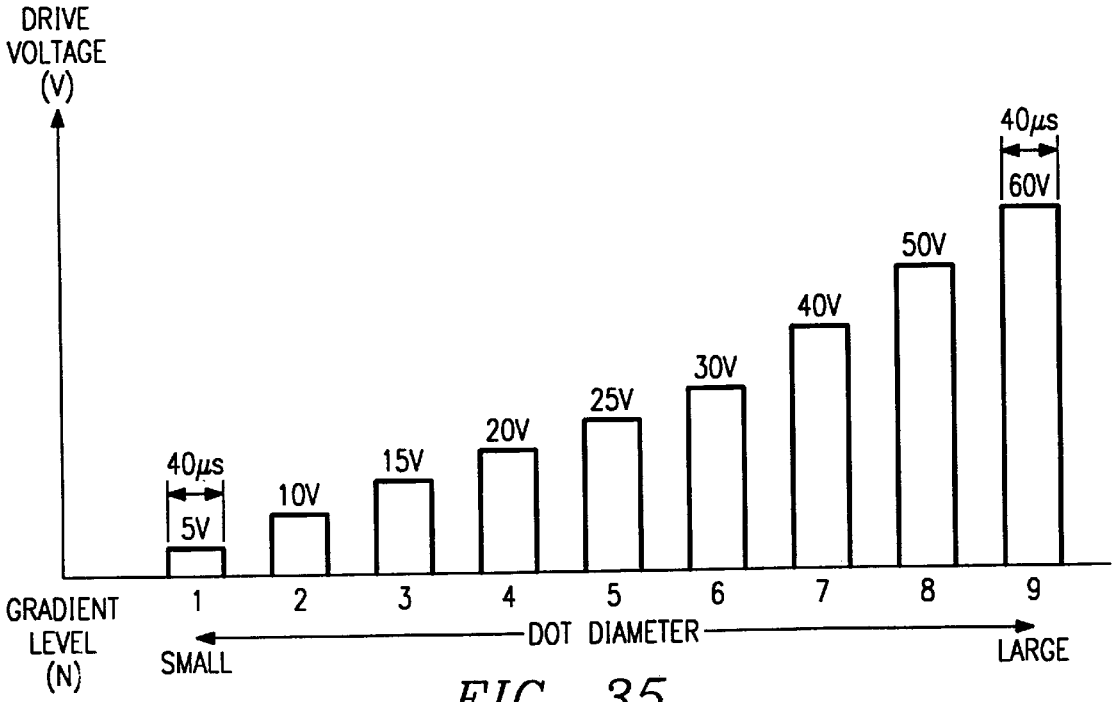
FIG. 35 (PRIOR ART)
FIG. 35 illustrates the dot gradient control executed in an inkjet printer of the conventional art.
Figure 34A:
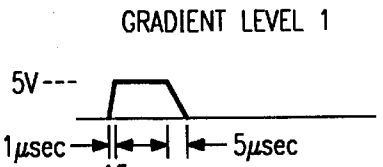
FIGS. 34(*a*)–34(*i*) illustrate the pulses which are applied to a piezoelectric element in an inkjet printer of a fifth embodiment of the present invention for each of the nine graduation levels.
Figure 34B:
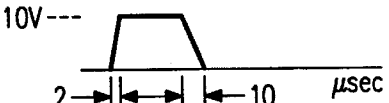
Figure 34C:
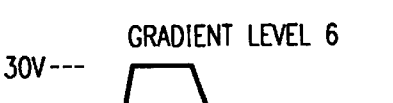
Figure 34D:
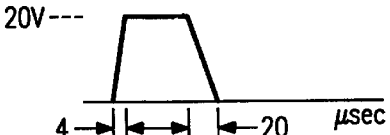
Figure 34E:
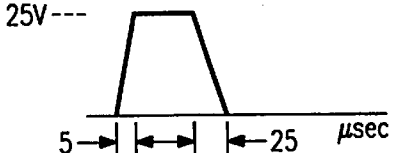
Figure 34F:
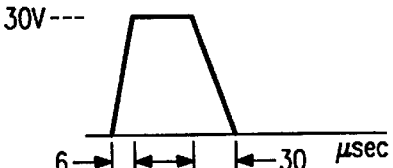
Figure 34G:
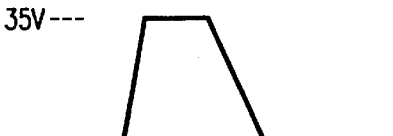
Figure 34H:
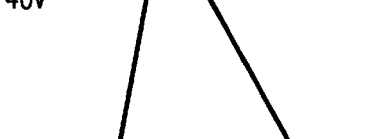
Figure 34I:
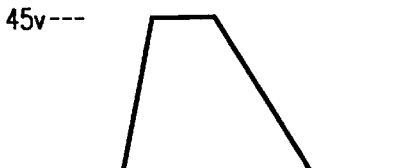

FIG. 33 is a graph illustrating the diameter of printed dots for each of the nine gradient levels using the above described printer drive approach. This data was generated using the voltage pulses depicted in FIGS. 32(*a*)–32(*i*).

A fifth embodiment of the present invention is described next. In addition to a printhead which has both large diameter and small diameter nozzles, an inkjet printhead may be constructed to print with nozzles of only a single diameter. Such a printhead may use only a partial range of the drive gradients that are illustrated in FIGS. 32(*a*)–32(*i*), i.e., gradient levels 1–6. That is, an inkjet printhead may be constructed that is capable of printing halftone dots via a single nozzle unit by inputting to a channel having a nozzle of specific diameter a number of pulses and a voltage having a drive waveform that changes in accordance with the gradient levels such as the gradient levels 1–6 of FIGS. 32(*a*)–32(*i*)

In this instance, although it is difficult to produce linear characteristics of output relative to input in the range of large dot diameter, the problem can be resolved by correcting the drive method for the large diameter range. For example, the number of pulses may be increased nonlinearly. In this case, large diameter dots can be printed by different combinations of number of pulses and voltage of the drive pulse waveform.

In the large diameter range of FIG. 32, only the voltage value is changed. As an alternative, the time of application of the voltage may be varied in accordance with the gradient level. Additionally, the voltage required at each gradient level can be reduced by changing the voltage application time.

For the fifth embodiment of the present invention, FIGS. 34(*a*)–34(*i*) illustrate the shapes of the pulse voltage applied to the piezoelectric element of an inkjet printer for gradient levels 1–9. In this embodiment, dots are printed at the nine gradient levels with a printhead having only a single diameter of nozzles. That is, in this embodiment, halftone dots can be printed with excellent results without using separate large and small diameter nozzles. The pulses shown in FIGS. 34(*a*)–34(*i*) have the same time of maximum pulse voltage of 15 μsec, but characteristically the pulse fall time and the pulse rise time, and the pulse maximum voltage values, are different.

Specifically, the voltage characteristics for the nine gradient levels are as follows:

| Gradient Level | Maximum Voltage (V) | Rise Time (μsec) | Fall Time (μsec) |
|---|---|---|---|
| 1 | 5 | 1 | 5 |
| 2 | 10 | 2 | 10 |
| 3 | 15 | 3 | 15 |
| 4 | 20 | 4 | 20 |
| 5 | 25 | 5 | 25 |
| 6 | 30 | 6 | 30 |
| 7 | 35 | 7 | 35 |
| 8 | 40 | 8 | 40 |
| 9 | 45 | 9 | 45 |

Thus, as shown in FIGS. 34(*a*)–34(*i*), it is possible to construct an inkjet printer that produces excellent print quality by applying a pulse to the piezoelectric elements of nozzles having a single diameter.

The present invention is not limited to inkjet printers having large diameter nozzles and small diameter nozzles for each color as in the previously described embodiments. For example, the previously described methods of voltage application may be modified for the discharge of inks from large diameter nozzles and small diameter nozzles so as to discharge normally relatively high density ink from the large diameter nozzles and discharge low density photo ink having superior halftone expression from the small diameter nozzles.

Although the nozzle for printing dots in the small diameter range and the nozzle for printing dots in the large diameter range have different diameters in the previously described embodiments, it to be noted that the nozzles may have the same diameters.

Additionally, while the large diameter range and the small diameter range do not overlap in the above described embodiments, it is to be understood that parts of these ranges may overlap.

The specific numeric values given for the voltage values, times, and the like in the above embodiments are examples only and the present invention is not limited to these values.

Although the present invention has been fully described by way of examples and with reference to the accompanying drawings, it is to be understood that various changes and modifications will be apparent to those skilled in the art without departing from the spirit and scope of the invention. Therefore, unless such changes and modifications depart from the scope of the present invention, they should be construed as being included therein.

What is claimed is:

1. An inkjet printer for printing dots of various sizes, which comprises:

an inkjet printhead, said inkjet printhead including a plurality of piezoelectric elements to which a voltage is applied to print a dot;

a first drive circuit for applying a first voltage to one of the plurality of piezoelectric elements according to a first drive method for printing variable sized dots having sizes belonging to a first range; and a second drive circuit for applying a second voltage to one of the plurality of piezoelectric elements according to a second drive method for printing variable sized dots having sizes belonging to a second range;

wherein said first range of dot sizes is different from said second range of dot sizes.

2. An inkjet printer as claimed in claim 1, wherein said first drive circuit applies said first voltage a plurality of times, and said first drive circuit drives one of the plurality of piezoelectric elements to change the dot size in said first range by changing a number of applications of said first voltage in the first drive method; and said second drive circuit drives one of the plurality of piezoelectric elements to change the dot size in said second range by changing an amplitude of said second voltage in the second drive method.

3. An inkjet printer as claimed in claim 2, wherein large dot sizes belong to said first range, and small dot sizes belong to said second range.

4. An inkjet printer as claimed in claim 1, wherein said first drive circuit applies to one of the plurality of piezoelectric elements a voltage pulse, said voltage pulse having a longer time required to fall than a time required to rise; and said second drive circuit applies to one of the plurality of piezoelectric elements a plurality of voltage pulses including a prepulse and a main pulse.

5. An inkjet printer as claimed in claim 1, wherein said inkjet printer has a large diameter nozzle and a small diameter nozzle, and said inkjet printer prints dots of sizes belonging to said first range by said large diameter nozzle and prints dots belonging to said second range by said small diameter nozzle.

6. An inkjet printer as claimed in claim 5, wherein:

said first drive circuit applies said first voltage a plurality of times, and said first drive circuit drives one of the plurality of piezoelectric elements to change the dot size in said first range by changing a number of applications of said first voltage in the first drive method; and said second drive circuit drives one of the plurality of piezoelectric elements to change the dot size in said second range by changing an amplitude of said second voltage in the second drive method.

7. An inkjet printer as claimed in claim 1, wherein said first drive method is different from said second drive method.

8. An inkjet printhead drive device for an inkjet printer for controlling a size of a dot to be printed, which comprises:

means for applying a voltage to a piezoelectric element in an inkjet printhead to print a dot; and means for pulse width control to selectably control an application time of the voltage applied to the piezoelectric element;

wherein said inkjet printhead prints a dot of a size selected from among dots of a plurality of different sizes, based on said application time of the voltage applied to the piezoelectric element; and wherein said means for pulse width control controls said application time of said voltage by controlling a time required for a rise and a time required for a fall of the voltage applied to said piezoelectric element.

9. An inkjet printhead drive device as claimed in claim 8, wherein the voltage application time to said piezoelectric element is 15 μsec or less, exclusive of said time required for the rise and said time required for the fall of said voltage.

10. A method of driving an inkjet printer to print dots of various sizes comprising the steps of:

providing an inkjet printhead having a plurality of piezoelectric elements to which a voltage is applied to print a dot;

applying a first voltage to one of the plurality of piezoelectric elements according to a first drive method for printing variable sized dots having sizes belonging to a first range; and applying a second voltage to one of the plurality of piezoelectric elements according to a second drive method for printing variable sized dots having sizes belonging to a second range;

wherein said first range of dot sizes is different from said second range of dot sizes.

11. A method of driving an inkjet printer as claimed in claim 10, wherein:

the step of applying a first voltage to one of the plurality of piezoelectric elements according to a first drive method to print variable sized dots having sizes belonging to a first range includes driving said one of the plurality of piezoelectric elements to change the dot size by changing a voltage amplitude of the first voltage; and the step of applying a second voltage to one of the plurality of piezoelectric elements according to a second drive method to print variable sized dots having sizes belonging to a second range includes driving said one of the plurality of piezoelectric elements to print dots by applying one or more voltage pulses and said second drive method changes the dot size by changing the number of voltage pulses applied.

12. A method of driving an inkjet printer as claimed in claim 10, wherein:

the step of applying a first voltage to one of the plurality of piezoelectric elements according to a first drive method to print variable sized dots having sizes belonging to a first range includes driving said one of the plurality of piezoelectric elements to change the dot size by applying a plurality of first voltage pulses including at least a prepulse and a main pulse; and the step of applying a second voltage to one of the plurality of piezoelectric elements according to a second drive method to print variable sized dots having sizes belonging to a second range includes driving said one of the plurality of piezoelectric elements to print a dot by applying a second voltage pulse, said second voltage pulse having a rise time and a fall time, and said fall time being longer than said rise time.

13. A method of driving an inkjet printer to print dots of various sizes comprising the steps of:

providing an inkjet printhead having a piezoelectric element to which a voltage is applied to print a dot; and applying a voltage to the piezoelectric element according to a drive method to print a dot of a selected size, said drive method varying said applied voltage to control the selected size of the printed dot;

wherein said applied voltage comprises a generally trapezoidal shaped voltage pulse having a total pulse time, said total pulse time comprising a rise time, a fall time, and a time at a maximum amplitude;

said rise time being between 3% and 20% of said total pulse time, and said fall time being between 15% and 75% of said total pulse time.

14. A method of driving an inkjet printer as claimed in claim 13, wherein said drive method varies both the total pulse time of the applied voltage as well as the maximum amplitude of the applied voltage to control the selected size of the printed dot, and wherein the time of maximum amplitude is less than 20 μsec.

15. An inkjet printhead drive device for an inkjet printer for controlling a size of a dot to be printed which comprises:

means for applying a voltage to a piezoelectric element in an inkjet printhead to print a dot, said applied voltage being a generally trapezoidal shaped voltage pulse having a total pulse time, said total pulse time comprising a rise time, a fall time, and a time at a maximum amplitude; and means for voltage pulse shape control to selectably control the maximum amplitude and total pulse time of the voltage pulse applied to the piezoelectric element to control the selected size of the printed dot;

wherein said voltage pulse rise time is between 3% and 20% of said total pulse time, and said voltage pulse fall time is between 15% and 75% of said total pulse time.

16. An inkjet printhead drive device as claimed in claim 15, wherein said means for voltage pulse shape control controls the maximum amplitude of the voltage pulse as well as the voltage pulse rise time, fall time, and time at a maximum amplitude to control the selected size of the printed dot, and wherein the time at a maximum amplitude is less than 20 μsec.

17. An inkjet printhead drive device for an inkjet printer for controlling a size of a dot to be printed which comprises:

means for applying a voltage to a piezoelectric element in an inkjet printhead to print a dot; and means for pulse width control to selectably control a voltage application time of the voltage applied to the piezoelectric element;

wherein said inkjet printhead prints a dot of a size selected from among dots of a plurality of different sizes, based on said application time of the voltage applied to the piezoelectric element; and wherein the voltage application time to said piezoelectric element is 15 μsec or less, exclusive of said time required for a rise and time required for a fall of said voltage.

18. An inkjet printer for printing dots of various size, which comprises:

an inkjet printhead, said inkjet printhead including a plurality of piezoelectric elements to which a voltage is applied to print a dot;

a first drive circuit to apply a first voltage to one of the plurality of piezoelectric elements according to a first drive method to print a dot of a size belonging to a first range; and a second drive circuit to apply a second voltage to one of the plurality of piezoelectric elements according to a second drive method to print a dot of a size belonging to a second range;

wherein said first range of dot sizes is different from said second range of dot sizes; and wherein said first drive method is different from said second drive method.

19. A method of driving an inkjet printer to print dots of various sizes comprising the steps of:

providing an inkjet printhead having a plurality of piezoelectric elements to which a voltage is applied to print a dot;

applying a first voltage to one of the plurality of piezoelectric elements according to a first drive method to print a dot of a size belonging to a first range; and applying a second voltage to one of the plurality of piezoelectric elements according to a second drive method to print a dot of a size belonging to a second range;

wherein said first range of dot sizes is different from said second range of dot sizes; and wherein said first drive method is different from said second drive method.

* * * * *

UNITED STATES PATENT AND TRADEMARK OFFICE
CERTIFICATE OF CORRECTION

PATENT NO : 6,126,263
DATED : October 3, 2000
INVENTOR(S) : Hideo Hotomi et al.

It is certified that error appears in the above-identified patent and that said Letters Patent are hereby corrected as shown below:

On the title page, [75] Inventors:, the first line, delete "Nishinomiya", and insert --Nishinomiya-Shi--.

On the Front Page [75] Inventors:, the second line, delete "Sakai", and insert --Sakai-Shi--.

Column 17, line 27 (claim 11, line 6), delete "said".

Column 17, line 35 (claim 11, line 13), delete "said".

Column 17, line 46 (claim 12, line 6), delete "said".

Column 17, line 54 (claim 12, line 13), delete "said".

Signed and Sealed this

Twenty-second Day of May, 2001

*Attest:*

Nicholas P. Godici

NICHOLAS P. GODICI

*Attesting Officer*

*Acting Director of the United States Patent and Trademark Office*